US011303028B2

(12) United States Patent
Zhao et al.

(10) Patent No.: US 11,303,028 B2
(45) Date of Patent: Apr. 12, 2022

(54) 5G MMW DUAL-POLARIZED ANTENNA MODULE AND HANDHELD DEVICE

(71) Applicant: SHENZHEN SUNWAY COMMUNICATION CO., LTD., Guangdong (CN)

(72) Inventors: Yue Zhao, Shenzhen (CN); Anping Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 62 days.

(21) Appl. No.: 16/769,411

(22) PCT Filed: Apr. 7, 2020

(86) PCT No.: PCT/CN2020/083471
§ 371 (c)(1),
(2) Date: Jun. 3, 2020

(87) PCT Pub. No.: WO2021/139015
PCT Pub. Date: Jul. 15, 2021

(65) Prior Publication Data

US 2021/0313695 A1 Oct. 7, 2021

(30) Foreign Application Priority Data

Jan. 10, 2020 (CN) ..... 202010024428.5

(51) Int. Cl.
*H01Q 1/24* (2006.01)
*H01Q 9/04* (2006.01)
(Continued)

(52) U.S. Cl.
CPC ..... *H01Q 9/0414* (2013.01); *H01Q 5/35* (2015.01); *H01Q 9/045* (2013.01); *H01Q 9/0435* (2013.01); *H01Q 25/001* (2013.01)

(58) Field of Classification Search
CPC ..... H01Q 9/0414; H01Q 25/001; H01Q 5/35; H01Q 9/0435; H01Q 9/045
See application file for complete search history.

(56) References Cited

U.S. PATENT DOCUMENTS

2014/0055304 A1* 2/2014 Lin ..... H01Q 1/24 343/702
2016/0043470 A1* 2/2016 Ko ..... H01Q 9/045 343/843
(Continued)

FOREIGN PATENT DOCUMENTS

CN 103066385 A 4/2013
CN 207517869 U 6/2018
(Continued)

OTHER PUBLICATIONS

Aug. 27, 2020 International Search Report issued in International Patent Application No. PCT/CN2020/083471.
(Continued)

*Primary Examiner* — Dieu Hien T Duong
(74) *Attorney, Agent, or Firm* — Oliff PLC

(57) ABSTRACT

A 5G MMW dual-polarized antenna module and a handheld device are disclosed. The antenna module comprises at least two antenna units. Each antenna unit comprises a first horizontal metal plate, a second horizontal metal plate, a first vertical metal plate, a second vertical metal plate and a patch antenna assembly. The antenna module can work within the 5G MMW frequency band and has the characteristic of dual polarization; and when applied to the handheld device, the antenna module will not increase the thickness of the handheld device and is conducive to ultra-thin development of the handheld device.

14 Claims, 12 Drawing Sheets

(51) Int. Cl.
*H01Q 5/35* (2015.01)
*H01Q 25/00* (2006.01)

(56) References Cited

U.S. PATENT DOCUMENTS

| | | | |
|---|---|---|---|
| 2019/0214728 | A1 | 7/2019 | Nysen et al. |
| 2019/0334241 | A1 | 10/2019 | Han et al. |

FOREIGN PATENT DOCUMENTS

| | | | |
|---|---|---|---|
| CN | 108288757 | A | 7/2018 |
| CN | 108346855 | A | 7/2018 |
| CN | 108470978 | A | 8/2018 |
| CN | 207781866 | U | 8/2018 |
| CN | 109193133 | A | 1/2019 |
| CN | 109193134 | A | 1/2019 |
| CN | 208460981 | U | 2/2019 |
| CN | 208655889 | U | 3/2019 |
| CN | 110416707 | A | 11/2019 |
| WO | 2019/165193 | A1 | 8/2019 |

OTHER PUBLICATIONS

Shengjie Wu et al. "Dual-Polarized Ring-Slot 5G Millimeter-Wave Antenna and Array Based on Metal Frame for Mobile Phone Applications". 13th European Conference on Antennas and Propagation, Apr. 5, 2019, 5 pages.

* cited by examiner

5G MMW DUAL-POLARIZED ANTENNA MODULE AND HANDHELD DEVICE

TECHNICAL FIELD

The invention relates to the technical field of antennas, in particular to a 5G MMW dual-polarized antenna module and a handheld device.

DESCRIPTION OF RELATED ART

The fifth-generation (5G) wireless communication technology will be soon commercially used. In accordance with the communication frequency, 5G can be divided into a sub-6 GHz frequency band and a millimeter wave (MMW) frequency band, wherein the MMW frequency band is rich in spectrum resources, can greatly increase the communication rate and has the advantage of low delay. Compared with previous low-frequency bands which have been widely applied, the path loss during MMW transmission is large, the MMW transmission distance is short, and hence, it is necessary to constitute an array by multiple antenna units to increase the gain and to fulfill a beam-forming capacity.

Accompanied with the technological innovation, new challenges have brought to the design of MMW antennas. Up to now, there have already been some designs of MMW antennas applied to handheld devices, but most existing MMW antennas have certain problems. For example, Chinese Invention Patents (Publication No. CN109193133A and Publication No. CN109193134A) put forward a series of antennas designed on metal frames, but the integration of such antennas with radio frequency front ends still remains unresolved. Antennas provided by Chinese Utility Model Patent "5G MMW Mobile Phone Antenna Based on Rectangular Patch Array" (Publication No. CN208655889U), Chinese Utility Model Patent "Four-unit MMW Antenna System for Mobile Communication Terminal" (Publication No. CN208460981U), and Chinese Utility Model Patent "Compact Wideband MMW Antenna" (Publication No. CN207781866U) are all designed based on broadside radiation. These antennas have to be vertically disposed on side faces of mobile phones to fulfill lateral radiation, which directly affects the thickness of the mobile phones. Chinese Utility Model Patent "End-radiation MMW Antenna with Controllable Radiation Direction" (Publication No. CN207517869U) and Chinese Utility Model Patent "Wireless Mobile Terminal and Antenna" (Publication No. CN108288757A) provide antenna units that can fulfill end radiation, but such antennas are single-polarized. Dual-polarized antennas can improve the channel capacity, thereby being more advantageous. Recently, Qualcomm has launched a dual-polarized MMW antenna module based on rectangular patch antennas; however, because the principal radiation direction of the antenna module is perpendicular to the surface of the patch antennas, the antenna module has to be vertically disposed on the side edge of mobile phones, which is not conducive to ultra-thin development of the mobile phones.

BRIEF SUMMARY OF THE INVENTION

The technical issue to be settled by the invention is to provide a 5G MMW dual-polarized antenna module which can fulfill lateral radiation and has a small thickness, and a handheld device.

One technical solution adopted by the invention to settle the aforesaid technical issues is as follows:

A 5G MMW dual-polarized antenna module comprises at least two antenna units. Each antenna unit comprises a first horizontal metal plate, a second horizontal metal plate, a first vertical metal plate, a second vertical metal plate and a patch antenna assembly, wherein a metal cavity for accommodating electronic components is defined by the first horizontal metal plate, the second horizontal metal plate, the first vertical metal plate and the second vertical metal plate; the patch antenna assembly is located on a side, away from the metal cavity, of the first vertical metal plate and comprises a first radiation part, a second radiation part and a third radiation part which are connected in sequence; and the first radiation part and the third radiation part are both located on a side, close to the first vertical metal plate, of the second radiation part.

Furthermore, each antenna unit further comprises a first feed structure and a second feed structure, wherein two ends of the first feed structure are respectively located on two opposite sides of the first vertical metal plate, and two ends of the second feed structure are respectively located on two opposite sides of the first vertical metal plate.

Furthermore, the first feed structure comprises a first vertical part, a first horizontal part and a second vertical part which are connected in sequence, wherein the first vertical part penetrates through a through hole in the third radiation part, and the first horizontal part penetrates through a through hole in the first vertical metal plate.

Furthermore, the second feed structure comprises a second horizontal part, a third horizontal part and a third vertical part which are connected in sequence, wherein the third horizontal part penetrates through a through hole in the first vertical metal plate, and the second horizontal part is disposed close to the patch antenna assembly.

Furthermore, the shape of the first feed structure may be changed as required, for example, a fourth horizontal part is disposed at an end, away from the first horizontal part, of the first vertical part; or, the first vertical part is transformed into a bent structure.

Furthermore, the first radiation part and the third radiation part are symmetrically disposed with respect to the second radiation part.

Furthermore, the first radiation part is circular, rectangular or regular polygonal, and the second radiation part is a metal plate structure or a metal mesh structure.

Furthermore, the second horizontal metal plate comprises a first metal part and a second metal part, wherein the first metal part and the second metal part are respectively located on two opposite sides of the first vertical metal plate, and the patch antenna assembly is located above the first metal part.

Furthermore, the 5G MMW dual-polarized antenna module further comprises an insulating substrate, and the antenna units are disposed in the insulating substrate. Furthermore, the 5G MMW dual-polarized antenna module is formed through an LTCC process.

Furthermore, a chip is integrated on a side, away from the first horizontal metal plate, of the second horizontal metal plate to feed power to the antenna unit. A radio frequency chip comprises a phase shifter, an amplifier and other elements, wherein the phase shifter can provide a phase difference for the antenna unit to fulfill a beam scanning capacity, the amplifier can compensate for the loss of the phase shifter, and a digital integrated circuit chip supplies power to the radio frequency chip.

Another technical solution adopted by the invention is as follows:

A handheld device comprises the 5G MMW dual-polarized antenna module.

The invention has the following beneficial effects: different electronic components such as feed lines, filters and switches can be disposed in the metal cavity; the patch antenna assembly is a folded patch antenna, which can fulfill lateral radiation and has a small thickness; the antenna module can work within the 5G MMW frequency band and has the characteristic of dual polarization; and when applied to the handheld device, the antenna module will not increase the thickness of the handheld device and is conducive to ultra-thin development of the handheld device.

REFERENCE SIGNS

Figure 1:
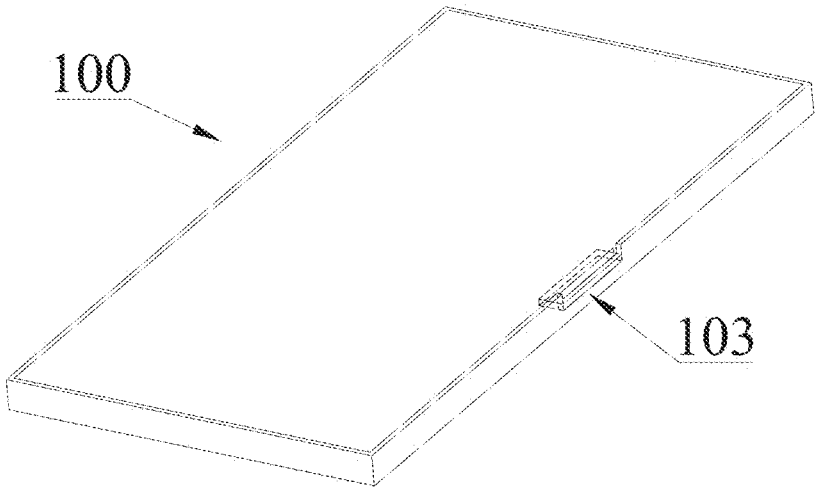
FIG. 1 is an overall structural view of a handheld device in Embodiment 1 of the invention.

100, handheld device; 101, screen; 102, PCB; 103, 5G MMW dual-polarized antenna module;

1, insulating substrate; 2, antenna unit; 21, first horizontal metal plate; 22, second horizontal metal plate; 221, first metal part; 222, second metal part; 23, first vertical metal plate; 24, second vertical metal plate; 25, patch antenna assembly; 251, first radiation part; 252, second radiation part; 253, third radiation part; 26, metal cavity; 27, radio frequency chip; 28, digital integrated circuit chip; 29, first feed structure; 291, first vertical part; 292, first horizontal part; 293, second vertical part; 294, fourth horizontal part; 30, second feed structure; 301, second horizontal part; 302, third horizontal part; 303, third vertical part; 3, traditional patch antenna.

DETAILED DESCRIPTION OF THE INVENTION

The technical contents, purposes and effects of the invention are expounded below in conjunction with the embodiments and accompanying drawings.

The key concept of the invention lies in that a patch antenna assembly comprises a first radiation part, a second radiation part and a third radiation part which are connected in sequence, wherein the first radiation part and the third radiation part are located on the same side of the second radiation part, so that lateral radiation is fulfilled, and the thickness is small.

Referring to FIG. 3 to FIG. 10, a 5G MMW dual-polarized antenna module 103 comprises at least two antenna units 2. Each antenna unit 2 comprises a first horizontal metal plate 21, a second horizontal metal plate 22, a first vertical metal plate 23, a second vertical metal plate 24 and a patch antenna assembly 25, wherein a metal cavity 26 for accommodating electronic components is defined by the first horizontal metal plate 21, the second horizontal metal plate 22, the first vertical metal plate 23 and the second vertical metal plate 24; and the patch antenna assembly 25 is located on a side, away from the metal cavity 26, of the first vertical metal plate 23 and comprises a first radiation part 251, a second radiation part 252 and a third radiation part 253 which are connected in sequence, and the first radiation part 251 and the third radiation part 253 are both located on a side, close to the first vertical metal plate 23, of the second radiation part 252.

From the above description, the invention has the following beneficial effects: different electronic components such as feed lines, filters and switches can be disposed in the metal cavity as required; the patch antenna assembly is a folded patch antenna, which can fulfill lateral radiation and has a small thickness; and the antenna module of the invention can work within the 5G MMW frequency band and has the characteristic of dual polarization. A chip can be integrated on a side, away from the first horizontal metal plate, of the second horizontal metal plate to feed power to the antenna unit. A radio frequency chip comprises a phase shifter, an amplifier and other elements, wherein the phase shifter can provide a phase difference for the antenna unit to fulfill a beam scanning capacity, and the amplifier can compensate for the loss of the phase shifter. A digital integrated circuit chip supplies power to the radio frequency chip.

Furthermore, each antenna unit 2 further comprises a first feed structure 29 and a second feed structure 30, wherein two ends of the first feed structure 29 are respectively located on two opposite sides of the first vertical metal plate 23, and two ends of the second feed structure 30 are respectively located on two opposite sides of the first vertical metal plates 23.

From the above description, the first feed structure and the second feed structure may be feed probes, and the shapes and positions of the first feed structure and the second feed structure can be set and adjusted as actually needed.

Furthermore, the first feed structure 29 comprises a first vertical part 291, a first horizontal part 292 and a second vertical part 293 which are connected in sequence, wherein the first vertical part 291 penetrates through a through hole in the third radiation part 253, and the first horizontal part 292 penetrates through a through hole in the first vertical metal plate 23.

From the above description, corresponding through holes are formed in the first vertical metal plate and the third radiation part to allow the first horizontal part and the first vertical part to penetrate through, the first vertical part does not contact with the third radiation part, and the first horizontal part does not contact with the first vertical metal plate.

Furthermore, the second feed structure 30 comprises a second horizontal part 301, a third horizontal part 302 and a third vertical part 303 which are connected in sequence, wherein the third horizontal part 302 penetrates through a through hole in the first vertical metal plate 23, and the second horizontal part 301 is disposed close to the patch antenna assembly 25.

From the above description, a corresponding through hole is formed in the first vertical metal plate to allow the second horizontal part to penetrate through, and the first vertical metal plate does not contact with the second horizontal part.

Furthermore, the shape of the first feed structure 29 may be changed as required. For example, a fourth horizontal part 294 is disposed at an end, away from the first horizontal part 291, of the first vertical part; or, the first vertical part 291 is transformed into a bent structure.

Furthermore, the first radiation part 251 and the third radiation part 253 are symmetrically disposed with respect to the second radiation part 252.

Furthermore, the first radiation part 251 is circular, rectangular or regular polygonal, and the second radiation part 252 is a metal plate structure or a metal mesh structure.

From the above description, the shapes of the first radiation part and the third radiation part can be selected as required. The second radiation part may be a multi-layer circuit board or LTCC, the metal mesh structure is easy to machine and comprises multiple metal patches which are disposed in a height direction of an insulating substrate in an aligned manner, and every two adjacent metal patches are communicated via a metal hole.

Furthermore, the second horizontal metal plate 22 comprises a first metal part 221 and a second metal part 222, wherein the first metal part 221 and the second metal part 222 are respectively located on two opposite sides of the first vertical metal plate 23, and the patch antenna assembly 25 is located above the first metal part 221.

Furthermore, the 5G MMW dual-polarized antenna module further comprises an insulating substrate 1, and the antenna units 2 are disposed in the insulating substrate 1.

From the above description, the material of the insulating substrate can be selected as required, and may be ceramic or the like.

Furthermore, the 5G MMW dual-polarized antenna module is formed through an LTCC process.

From the above description, when the LTCC process is adopted to form the 5G MMW dual-polarized antenna module, the second radiation part, the first vertical metal plate and the second vertical metal plate may be mesh structures which are easy to machine, and the antenna module may be a multi-layer circuit board structure.

Figure 2:
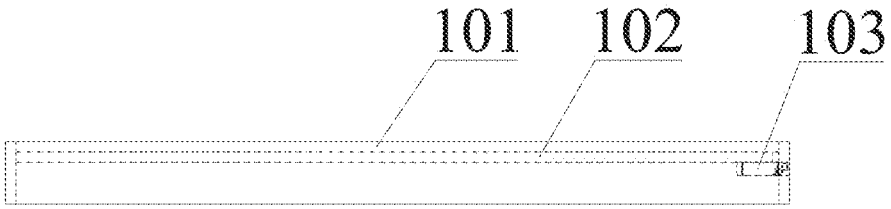
FIG. 2 is a side view of the handheld device in Embodiment 1 of the invention.
Figure 3:
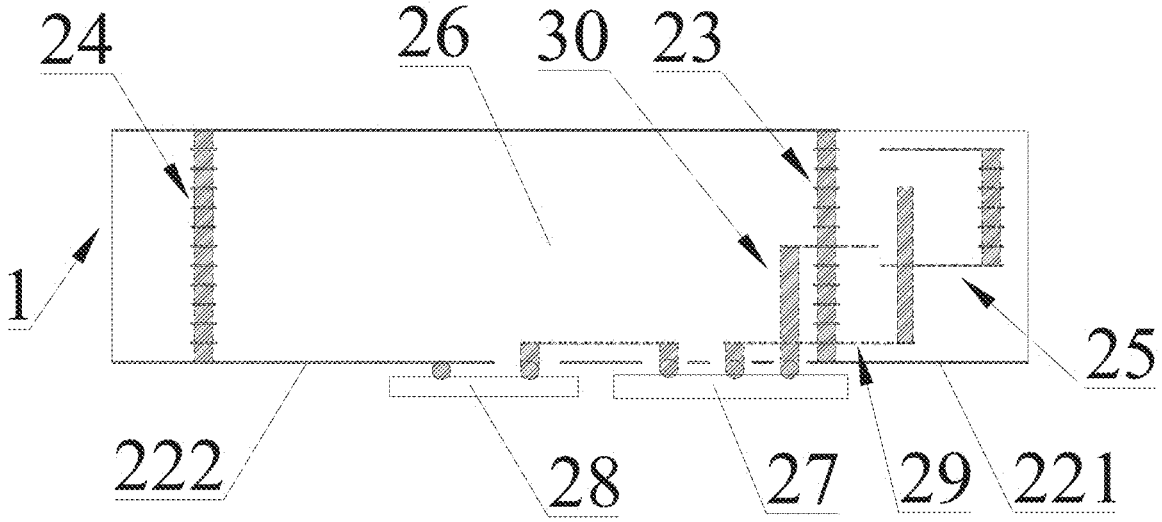
FIG. 3 is a side view of a 5G MMW dual-polarized antenna module of the invention.
Figure 4:
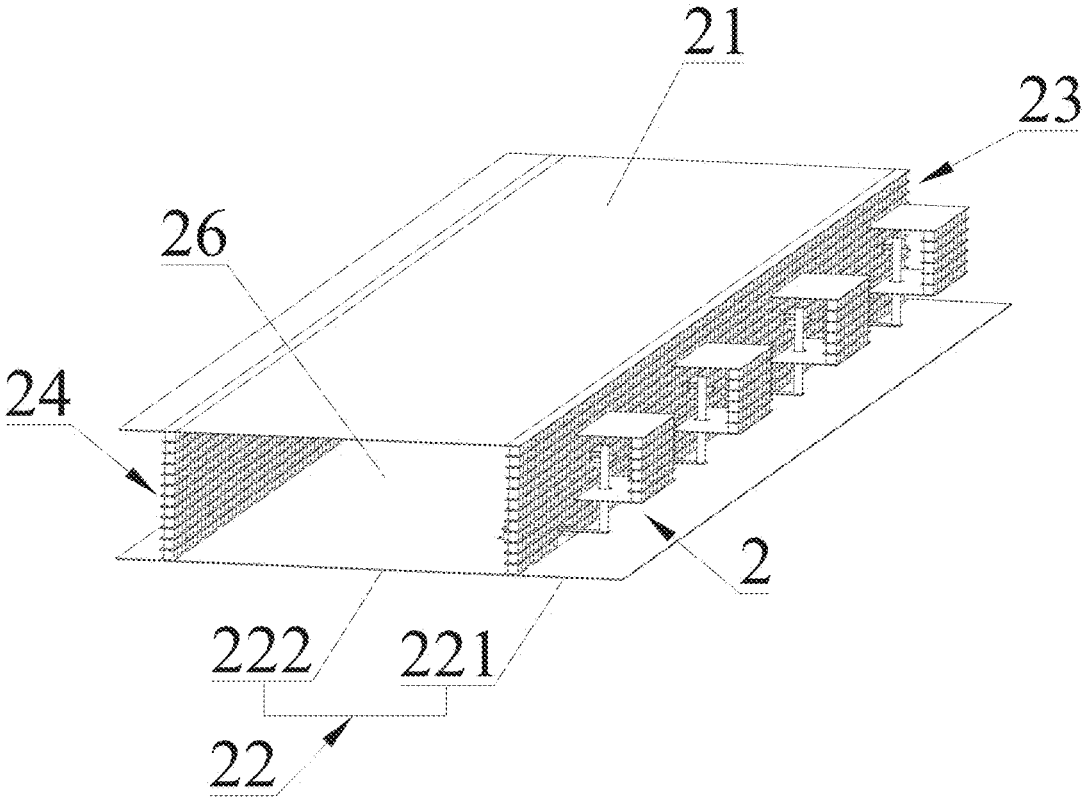
FIG. 4 is a partial structural view of the 5G MMW dual-polarized antenna module of the invention.
Figure 5:
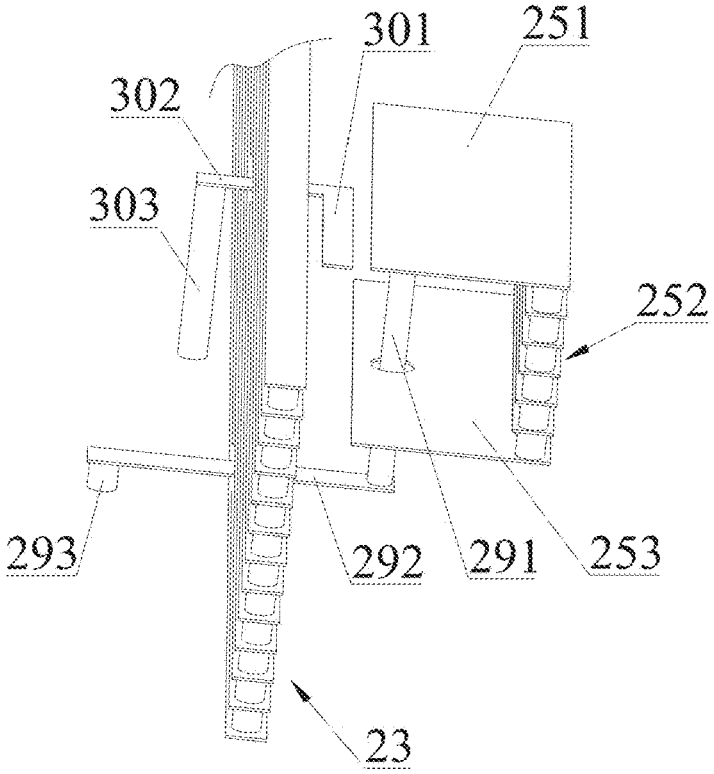
FIG. 5 is a partial structural view of an antenna unit of the invention.

Referring to FIG. 1 and FIG. 2, another technical solution adopted by the invention is as follows:

A handheld device 100 comprises the 5G MMW dual-polarized antenna module 103.

From the above description, when applied to the handheld device, the antenna module will not increase the thickness of the handheld device and is conductive to ultra-thin development of the handheld device; and the antenna module can be disposed on a long edge or a short edge of the handheld device, and the handheld device may be a mobile phone.

Embodiment 1

Referring to FIG. 1 to FIG. 23, Embodiment 1 of the invention is as follows:

A handheld device 100, as shown in FIG. 1 and FIG. 2, comprises a screen 101, a PCB 102 and a 5G MMW dual-polarized antenna module 103, wherein the 5G MMW dual-polarized antenna module 103 is disposed on a side, away from the screen 101, of the PCB 102 and is located on a long edge of the PCB 102. Obviously, the position and number of the 5G MMW dual-polarized antenna module 103 can be selected as required, and the handheld device 100 may be a mobile phone.

As shown in FIG. 3 to FIG. 7, the 5G MMW dual-polarized antenna module 103 comprises an insulating substrate 1 and at least two antenna units 2, wherein the antenna units 2 are disposed in the insulating substrate 1; the material of the insulating substrate 1 can be selected as required and can be, for example, ceramic; for instance, if the insulating substrate 1 is made of a material with a dielectric constant of 5.9 through an LTCC process and the layer thickness is set to 100 um, the 5G MMW dual-polarized antenna module 103 at 28 GHz should include 12 layers and has an overall thickness of about 1.2 mm; and the number of the antenna units 2 can be set as required and can be, for example, four. Each antenna unit 2 comprises a first horizontal metal plate 21, a second horizontal metal plate 22, a first vertical metal plate 23, a second vertical metal plate 24 and a patch antenna assembly 25, wherein a metal cavity 26 for accommodating electronic components is defined by the first horizontal metal plate 21, the second horizontal metal plate 22, the first vertical metal plate 23 and the second vertical metal plate 24; in this embodiment, the first horizontal metal plate 21 and the second horizontal metal plate 22 are preferably disposed in parallel, the first vertical metal plate 23 and the second vertical metal plate 24 are disposed in parallel and may be metal mesh structures as required by machining; and each metal mesh structure comprises multiple metal patches which are disposed in a height direction of the insulating substrate 1 in an aligned manner, every two adjacent metal patches are communicated via a metal hole, and the diameter of the metal hole can be set as required, for example, at 28 GHz, the distance between hundreds of micro-sized metal holes is generally about twice the diameter of the metal holes. Electronic components such as feed lines, filters and switches can be disposed in the metal cavity 26. A radio frequency chip 27 may be integrated on a side, away from the first horizontal metal plate 21, of the second horizontal metal plate 22 to feed power to the antenna unit 2 and includes a phase shifter, an amplifier and other elements, wherein the phase shifter can provide a phase difference for the antenna unit 2 to fulfill a beam scanning capacity, the amplifier can compensate for the loss of the phase shifter, and a digital integrated circuit chip 28 supplies power to the radio frequency chip 27. The patch antenna assembly 25 is located on a side, away from the metal cavity 26, of the first vertical metal plate 23 and comprises a first radiation part 251, a second radiation part 252 and a third radiation part 253 which are connected in sequence, wherein the first radiation part 251 and the third radiation part 253 are both located on a side, close to the first vertical metal plate 23, of the second radiation part 252, and an angle between the first radiation part 251 and the second radiation part 252 and an angle between the third radiation part 253 and the second radiation part 252 can be set as required and may be both 90° to facilitate machining. The first radiation part 251 and the third radiation part 253 are symmetrically disposed with respect to the second radiation part 252 and are circular, rectangular or regular polygonal, and the second radiation part 252 may be a metal mesh structure or a metal sheet, and may be machined, for example, through a multi-layer circuit board or LTCC process; and in the case where the second radiation part 252 is a metal mesh structure, the metal mesh structure comprises multiple metal patches which are disposed in a height direction of the insulating substrate 1 in an aligned manner, and every two adjacent metal patches are communicated via a metal hole. The second horizontal metal plate 22 comprises a first metal part 221 and a second metal part 222, wherein the first metal part 221 and the second metal part 222 are respectively located on two opposite sides of the first vertical metal plate 23, and the patch antenna assembly 25 is located above the first metal part 221. Each antenna unit 2 further comprises a first feed structure 29 and a second feed structure 30, wherein two ends of the first feed structure 29 are respectively located on two opposite sides of the first vertical metal plate 23, and two ends of the second feed structure 30 are respectively located on two opposite sides of the first vertical metal plate 23. In this embodiment, the first feed structure 29 comprises a first vertical part 291, a first horizontal part 292 and a second vertical part 293 which are connected in sequence, wherein the first vertical part 291 penetrates through a through hole in the third radiation part 253, and the first horizontal part 292 penetrates through a through hole in the first vertical metal plate 23, that is, an end, away from the second vertical part 293, of the first vertical part 291 is located inside the patch antenna assembly 25. The second feed structure 30 comprises a second horizontal part 301, a third horizontal part 302 and a third vertical part 303 which are connected in sequence, wherein the third horizontal part 302 penetrates through a through hole in the first vertical metal plate 23, and the second horizontal part 301 is disposed close to the patch antenna assembly 25. In this embodiment, the first feed structure 29 and the second feed structure 30 are feed probes, and the shapes and positions of the first feed structure 29 and the second feed structure 30 can be adjusted as required.

Figure 6:
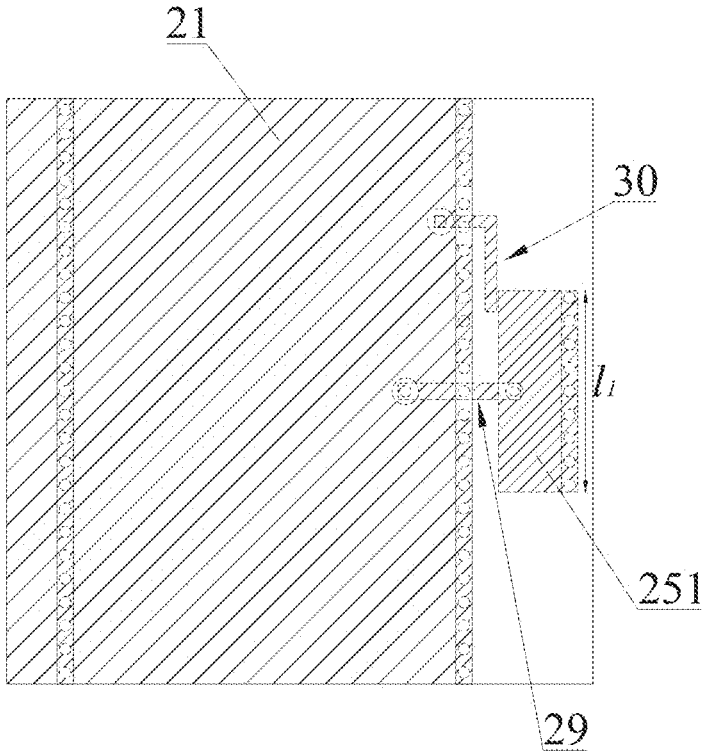
FIG. 6 is a top view of the antenna unit of the invention.
Figure 7:
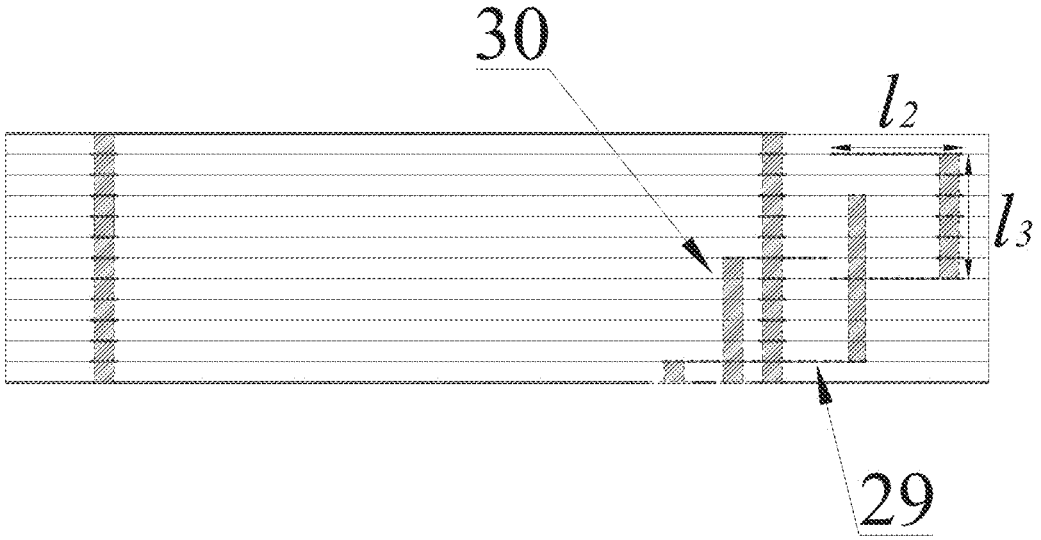
FIG. 7 is a side view of the antenna unit of the invention.

As shown in FIG. 6 and FIG. 7, dimensions $l_1$, $l_2$ and $l_3$ have an influence on the operating frequency of the 5G MMW dual-polarized antenna module 103. In this embodiment, when the insulating substrate is made of a material with a dielectric constant of 5.9, the dimension $l_1$ is preferably about 1.7 mm, and the sum of twice the dimension $l_2$ and the dimension $l_3$ is about 1.8 mm, to fulfill 5G transmission at 28 GHz.

Figure 8:
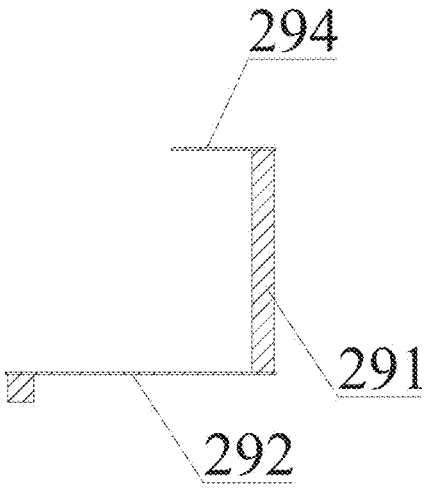
FIG. 8 is a partial structural view of the antenna unit of the invention.
Figure 9:
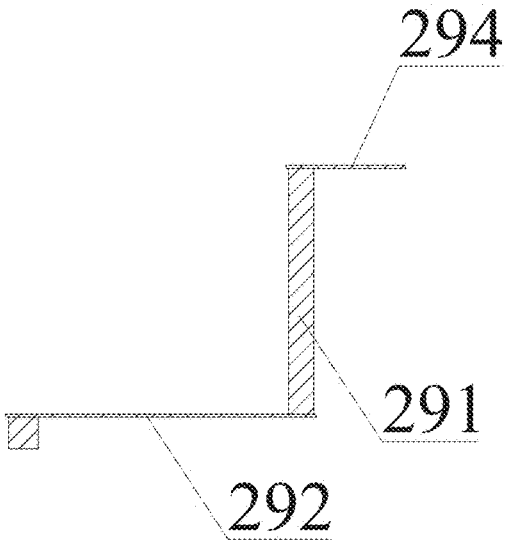
FIG. 9 is another partial structural view of the antenna unit of the invention.
Figure 10:
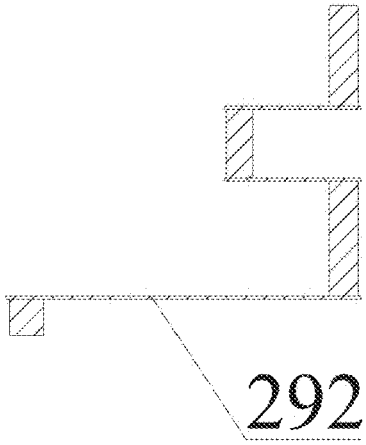
FIG. 10 is another partial structural view of the antenna unit of the invention.

In this embodiment, the shape of the first feed structure can be changed as required. For example, a fourth horizontal part 294 is disposed at an end, away from the first horizontal part 292, of the first vertical part 291, as shown in FIG. 8 and FIG. 9; or, the first vertical part 291 is transformed into a bent structure, as shown in FIG. 10.

Figure 11:
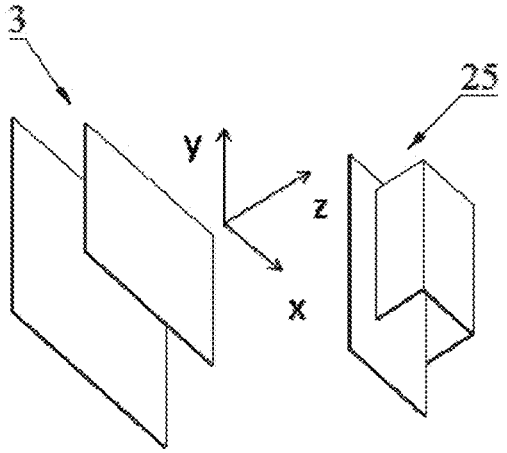
FIG. 11 is a structural comparison diagram of a traditional patch antenna and a patch antenna assembly of the invention.
Figure 12:
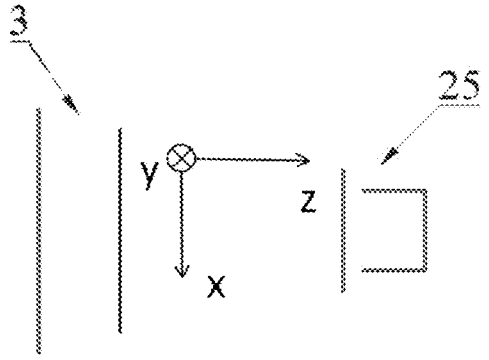
FIG. 12 is a structural comparison diagram (side view) of the traditional patch antenna and the patch antenna assembly of the invention.

As shown in FIG. 11 and FIG. 12 which are comparison diagrams of a traditional patch antenna 3 and the patch antenna assembly 25 in this embodiment, the principal radiation direction of the traditional patch antenna 3 and the principal radiation direction of the patch antenna assembly 25 in this embodiment are both the z-axis direction, and when the traditional patch antenna 3 and the patch antenna assembly 25 are disposed in mobile phones to fulfill lateral radiation, the dimension in the x-axis direction will be one of the influence factors of the thickness of the mobile phones. The traditional patch antenna 3 has a large dimension in the x-axis direction, which is not conducive to the ultra-thin design of the mobile phones. The dimension in the x-axis direction of the patch antenna assembly 25 in this embodiment is greatly decreased, thus being conducive to the ultra-thin design of the mobile phones.

Figure 13:
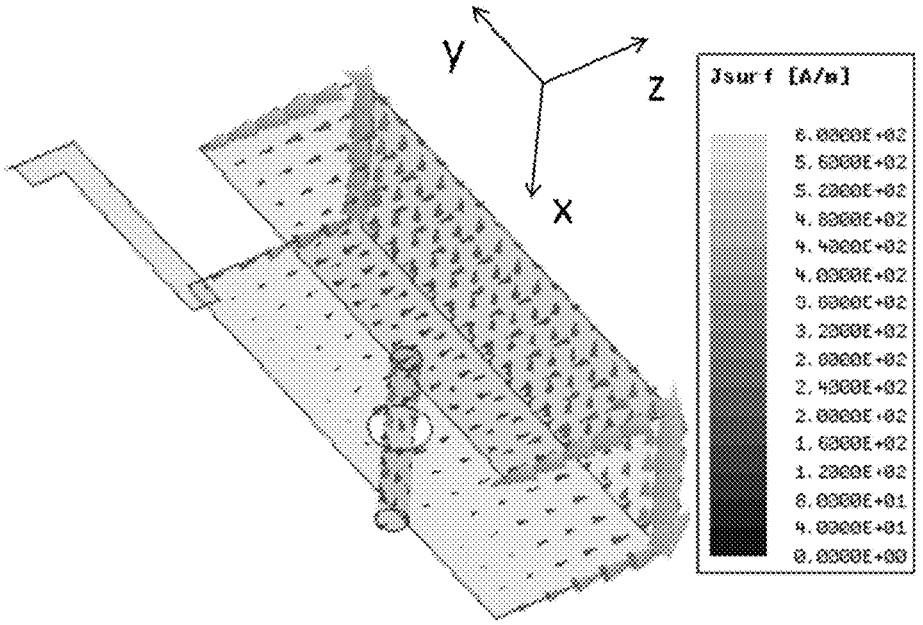
FIG. 13 is a current distribution diagram of the antenna unit at 28 GHz of the invention (power is fed by means of a first feed structure)
Figure 14:
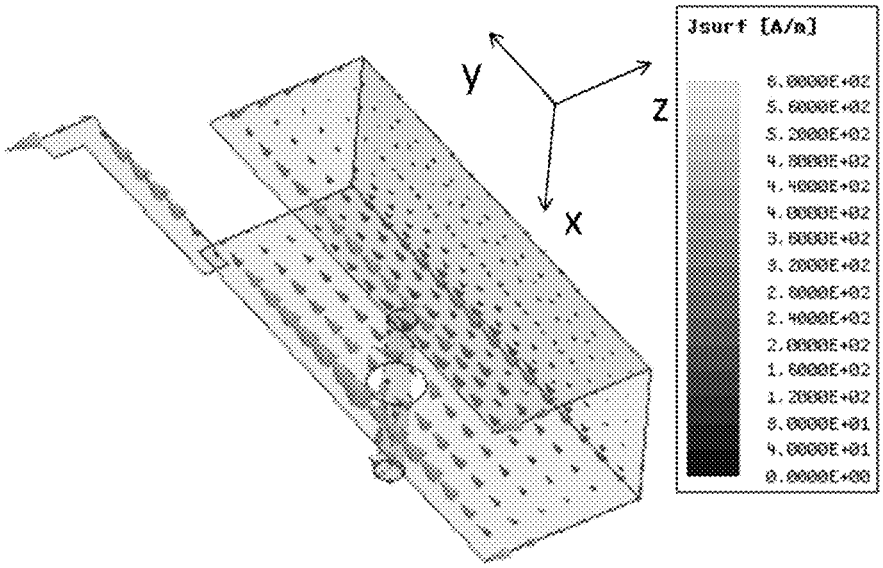
FIG. 14 is a current distribution diagram of the antenna unit at 28 GHz of the invention (power is fed by means of a second feed structure)

FIG. 13 is a current distribution diagram when power is fed by means of the first feed structure, and FIG. 14 is a current distribution diagram when power is fed by means of the second feed structure. As can be seen from FIG. 13 and FIG. 14, when the first feed structure is used for feed excitation, currents are concentrated on the left and right edges and are distributed primarily in the x-axis direction, which presents a typical TM10 mode, that is, vertical polarization can be fulfilled when power is fed by means of the first feed structure; and when the second feed structure is used for feed excitation, currents are concentrated on the upper and lower edges and are gradually weakened from middle to two sides in the y-axis direction, which presents a typical TM01 mode, that is, horizontal polarization can be fulfilled when power is fed by means of the second feed structure.

Figure 15:
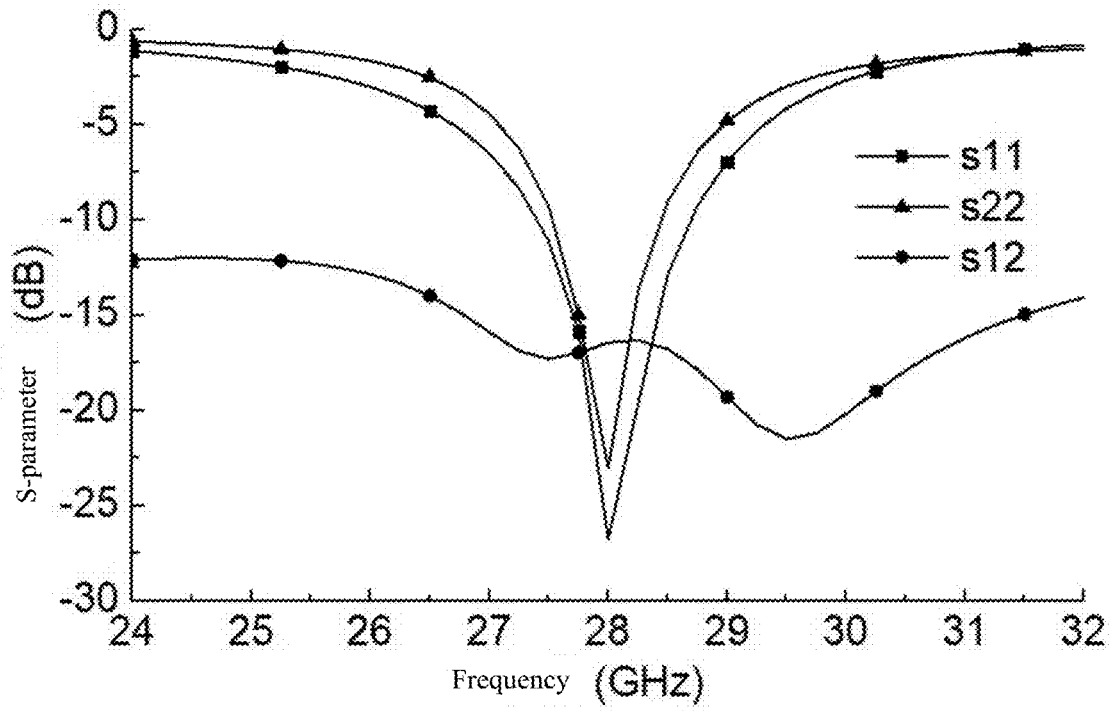
FIG. 15 is an S-parameter diagram of the antenna unit of the invention.

FIG. 15 is an S-parameter diagram of the antenna unit. As can be seen from FIG. 15, the standing wave loss at the frequency of 28 GHz is less than −10 dB, and the isolation between two feed ports is superior to 16 dB.

Figure 16:
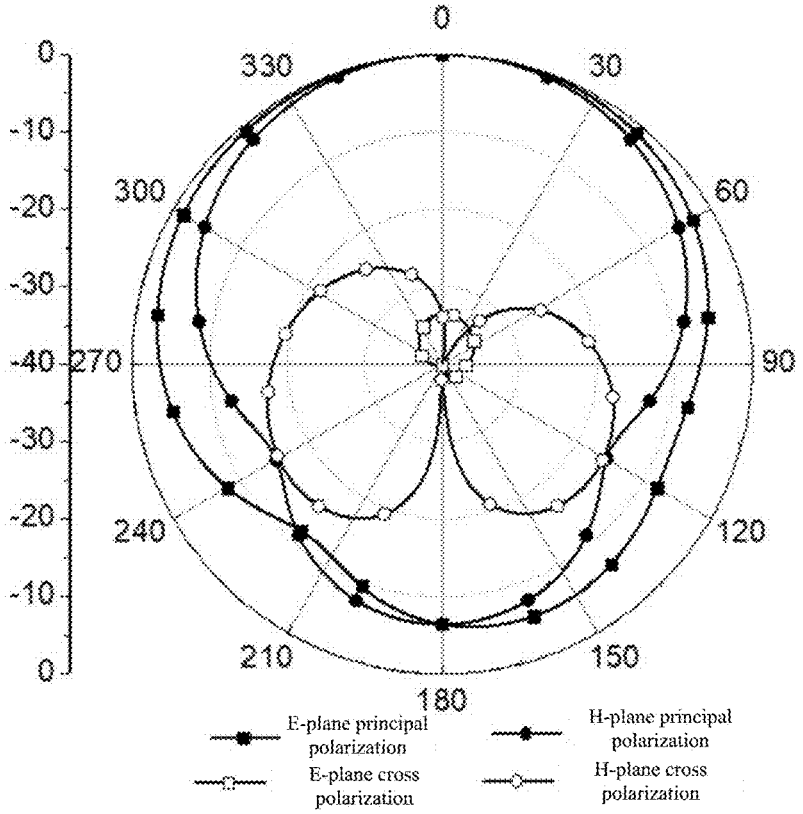
FIG. 16 is a directional diagram of the antenna unit of the invention (power is fed by means of the first feed structure)
Figure 17:
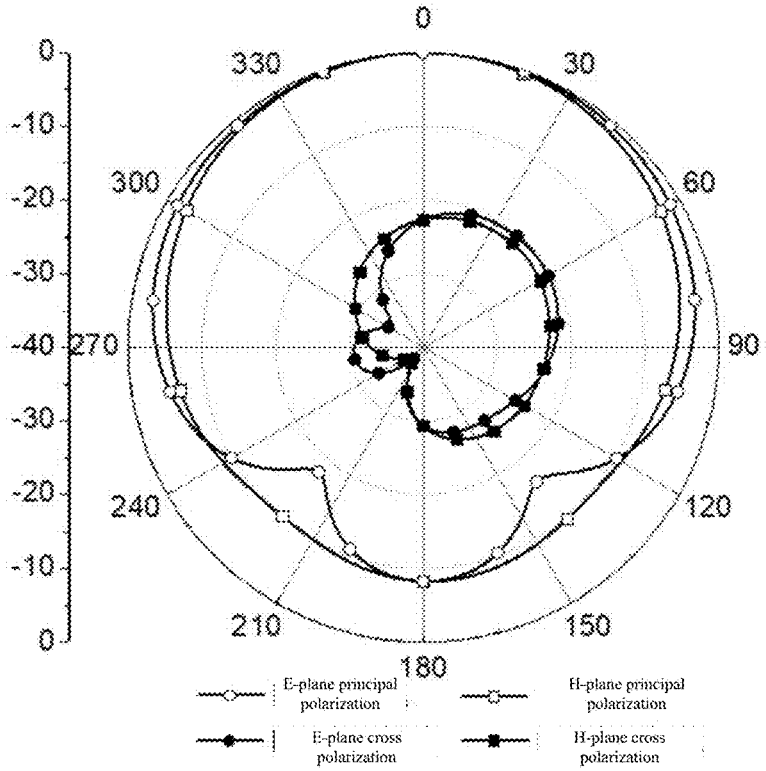
FIG. 17 is a directional diagram of the antenna unit of the invention (power is fed by means of the second feed structure)
Figure 18:
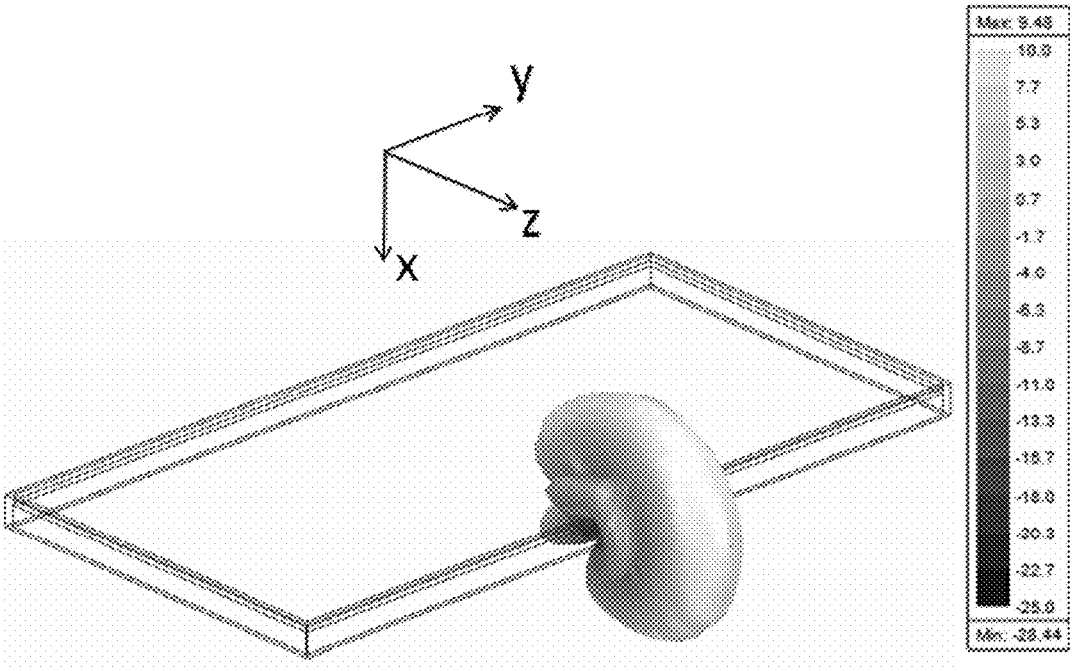
FIG. 18 is a radiation direction diagram of the 5G MMW dual-polarized antenna module on the handheld device in Embodiment 1 of the invention (under vertical polarization and a scan angle of 0°)
Figure 19:
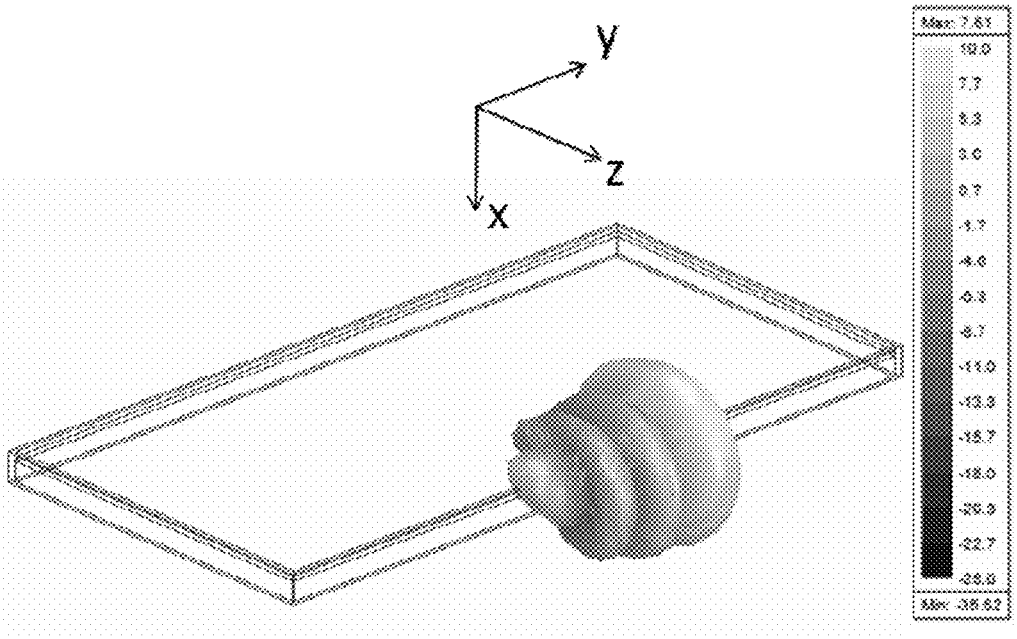
FIG. 19 is a radiation direction diagram of the 5G MMW dual-polarized antenna module on the handheld device in Embodiment 1 of the invention (under vertical polarization and a scan angle of 45°)
Figure 20:
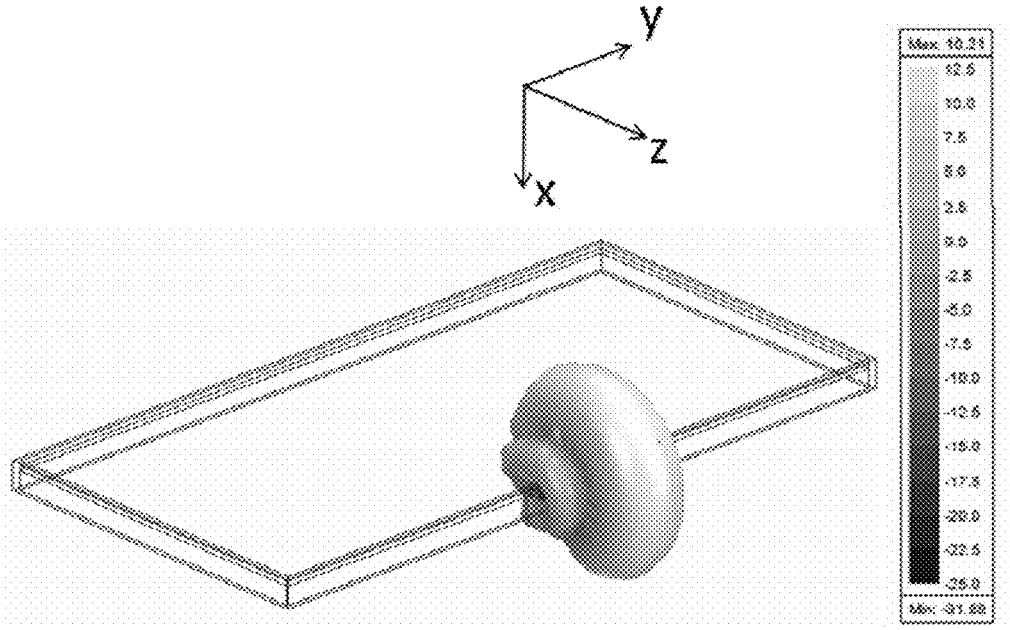
FIG. 20 is a radiation direction diagram of the 5G MMW dual-polarized antenna module on the handheld device in Embodiment 1 of the invention (under horizontal polarization and a scan angle of 0°)
Figure 21:
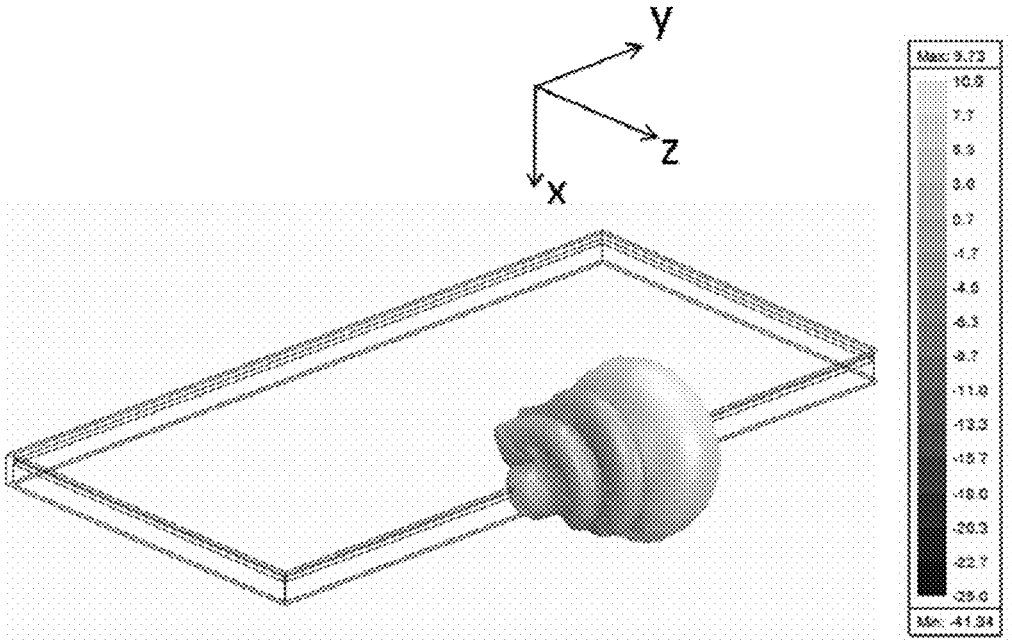
FIG. 21 is a radiation direction diagram of the 5G MMW dual-polarized antenna module on the handheld device in Embodiment 1 of the invention (under horizontal polarization and a scan angle of 50°)

FIG. 16 and FIG. 17 are directional diagrams of the antenna units. As can be seen from FIG. 16 and FIG. 17, the antenna unit can fulfill directed radiation and has good cross polarization.

FIG. 18 to FIG. 21 are radiation direction diagrams of the 5G MMW dual-polarized antenna module on the handheld device (28 GHz). As can be seen from FIG. 18 to FIG. 21, the 5G MMW dual-polarized antenna module in this embodiment can fulfill lateral radiation of mobile phones and has a beam scanning capacity.

Figure 22:
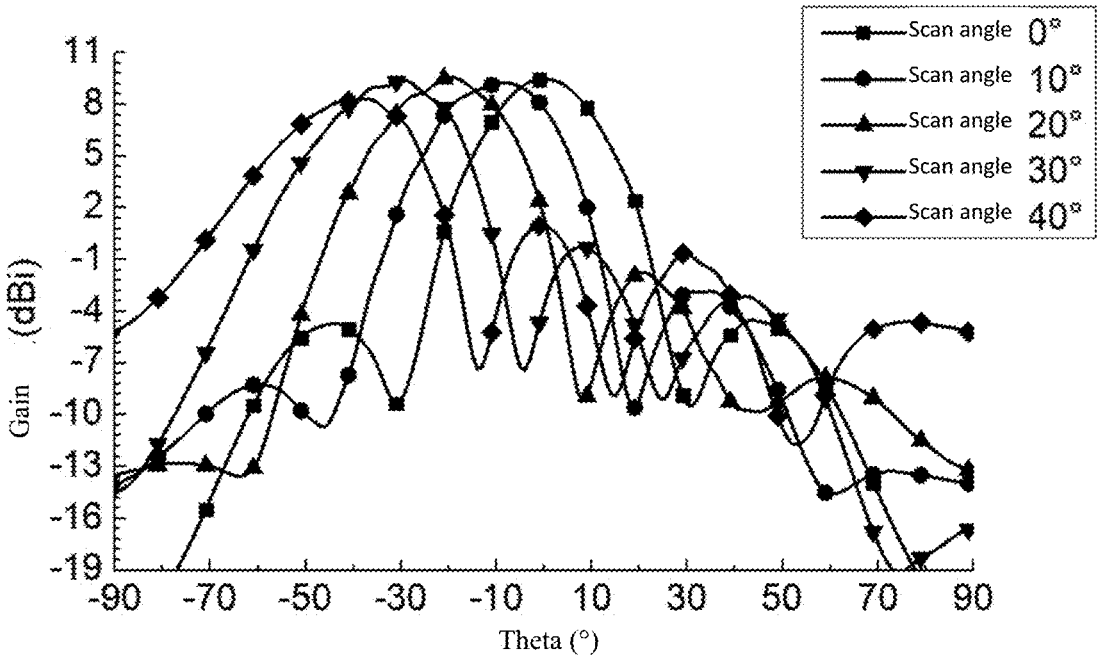
FIG. 22 is a scanning direction diagram of the 5G MMW dual-polarized antenna module on the handheld device in Embodiment 1 of the invention (under vertical polarization and a scan angle of 0-40°)
Figure 23:
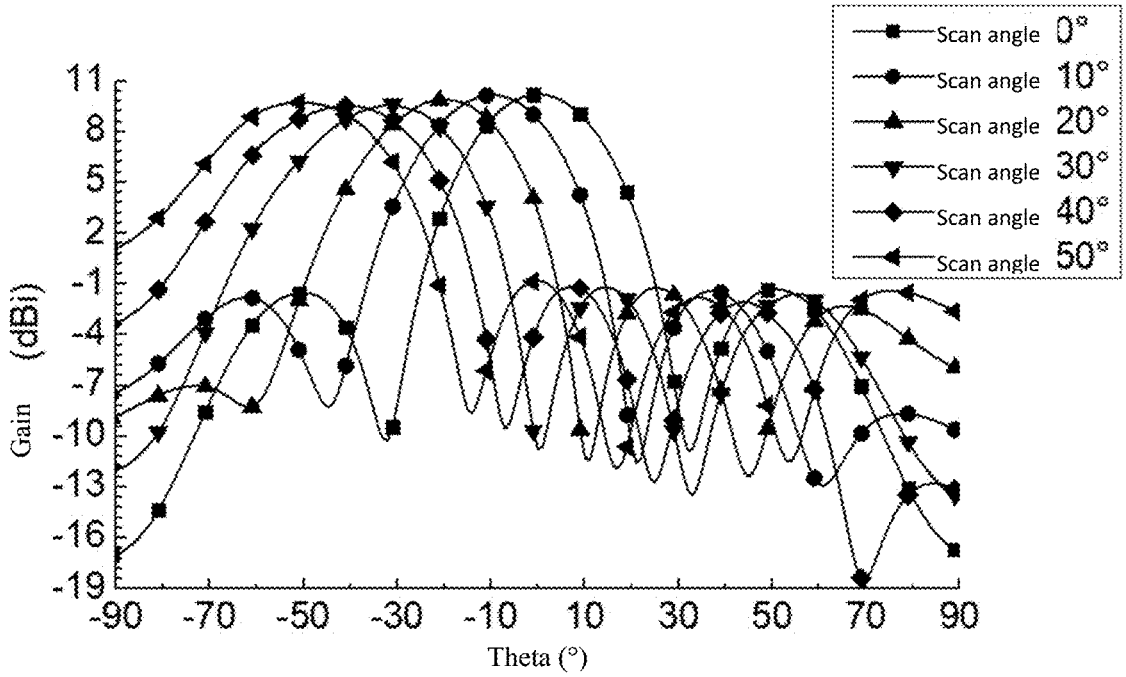
FIG. 23 is a scanning direction diagram of the 5G MMW dual-polarized antenna module on the handheld device in Embodiment 1 of the invention (under horizontal polarization and a scan angle of 0-50°)

FIG. 22 and FIG. 23 show the scanning performance of the 5G MMW dual-polarized antenna module. As can be seen from FIG. 22 and FIG. 23, the vertical polarization is within 0-±40°, the horizontal polarization is within 0-±50°, the gain in the direction diagrams is stable, and the scanning performance is good.

Embodiment 2

Figure 24:
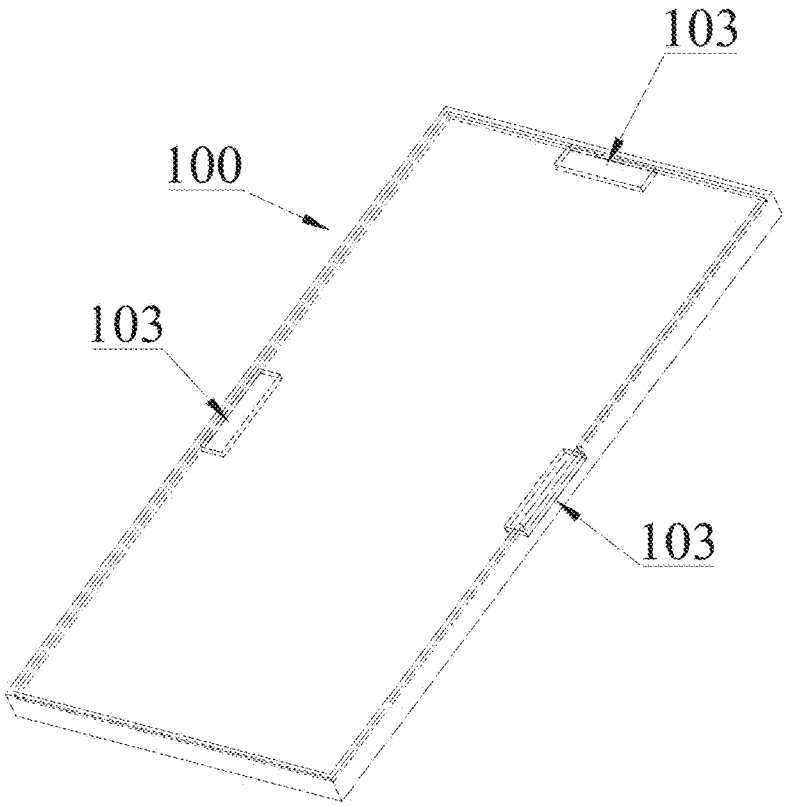
FIG. 24 is an overall structural view of a handheld device in Embodiment 2 of the invention.
Figure 25:
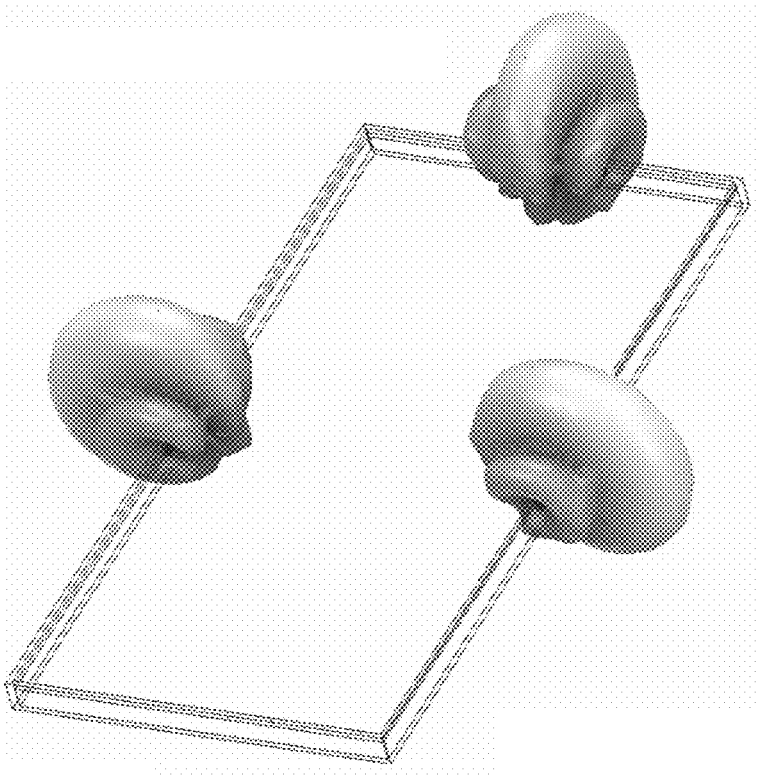
FIG. 25 is a radiation direction diagram of the 5G MMW dual-polarized antenna modules on the handheld device in Embodiment 2 of the invention (under a scan angle of 0-50°)

Referring to FIG. 24 and FIG. 25, Embodiment 2 of the invention provides a handheld device 100. Different from Embodiment 1, as shown in FIG. 24, the handheld device 100 is provided with three 5G MMW dual-polarized antenna modules 103, wherein two of the three 5G MMW dual-polarized antenna modules 103 are disposed on long edges of the handheld device 100, and the other 5G MMW dual-polarized antenna module 103 is disposed on a short edge of the handheld device 100. FIG. 25 is a radiation direction diagram of the 5G MMW dual-polarized antenna modules on the handheld device. As can be seen from FIG. 25, the three antenna modules are respectively disposed on three side edges of a mobile phone to fulfill multi-directional coverage.

According to the 5G MMW dual-polarized antenna module and the handheld device provided by the invention, the 5G MMW dual-polarized antenna module has the advantage of dual polarization, can fulfill lateral radiation, and has a small thickness, which is conducive to ultra-thin development of the handheld device; and the antenna module can be formed through a multi-layer circuit board or LTCC process to facilitate subsequent chip integration.

The above description is merely used to illustrate the embodiments of the invention, and is not intended to limit the patent scope of the invention. All equivalent transformations made on the basis of the contents of the specification and accompanying drawings, or direct or indirect applications to relating technical fields should also fall within the patent protection scope of the invention.

The invention claimed is:

1. A 5G MMW dual-polarized antenna module comprising at least two antenna units, wherein each said antenna unit comprises a first horizontal metal plate, a second horizontal metal plate, a first vertical metal plate, a second vertical metal plate and a patch antenna assembly, a metal cavity for accommodating electronic components that is defined by the first horizontal metal plate, the second horizontal metal plate, the first vertical metal plate and the second vertical metal plate, and a first feed structure and a second feed structure, wherein two ends of the first feed structure are respectively located on two opposite sides of the first vertical metal plate, and two ends of the second feed structure are respectively located on the two opposite sides of the first vertical metal plate, the patch antenna assembly is located on a side, away from the metal cavity, of the first vertical metal plate and comprises a first radiation part, a second radiation part and a third radiation part which are connected in sequence, the first radiation part and the third radiation part are both located on a side, close to the first vertical metal plate, of the second radiation part, the first feed structure comprises a first vertical part, a first horizontal part and a second vertical part which are connected in sequence, the first vertical part penetrates through a through hole in the third radiation part, and the first horizontal part penetrates through a through hole in the first vertical metal plate.

2. The 5G MMW dual-polarized antenna module according to claim 1, wherein the second feed structure comprises a second horizontal part, a third horizontal part and a third vertical part which are connected in sequence, the third horizontal part penetrates through another through hole in the first vertical metal plate, and the second horizontal part is disposed close to the patch antenna assembly.

3. A handheld device comprising the 5G MMW dual-polarized antenna module according to claim 2.

4. The 5G MMW dual-polarized antenna module according to claim 1, wherein the first radiation part and the third radiation part are symmetrically disposed with respect to the second radiation part.

5. The 5G MMW dual-polarized antenna module according to claim 4, wherein the first radiation part is circular, rectangular or regular polygonal, and the second radiation part is a metal plate structure or a metal mesh structure.

6. A handheld device comprising the 5G MMW dual-polarized antenna module according to claim 5.

7. A handheld device comprising the 5G MMW dual-polarized antenna module according to claim 4.

8. The 5G MMW dual-polarized antenna module according to claim 1, wherein the second horizontal metal plate comprises a first metal part and a second metal part, the first metal part and the second metal part are respectively located on the two opposite sides of the first vertical metal plate, and the patch antenna assembly is located above the first metal part.

9. A handheld device comprising the 5G MMW dual-polarized antenna module according to claim 8.

10. The 5G MMW dual-polarized antenna module according to claim 1, further comprising an insulating substrate, wherein the antenna units are disposed in the insulating substrate.

11. A handheld device comprising the 5G MMW dual-polarized antenna module according to claim 10.

12. The 5G MMW dual-polarized antenna module according to claim 1, wherein the 5G MMW dual-polarized antenna module is formed through an LTCC process.

13. A handheld device comprising the 5G MMW dual-polarized antenna module according to claim 12.

14. A handheld device comprising the 5G MMW dual-polarized antenna module according to claim 1.

* * * * *